US010240804B2

(12) United States Patent
Wang et al.

(10) Patent No.: US 10,240,804 B2
(45) Date of Patent: Mar. 26, 2019

(54) WALL-MOUNTED AIR CONDITIONER INDOOR UNIT

(71) Applicant: QINGDAO HAIER AIR CONDITIONER GENERAL CORP., LTD., Qingdao, Shandong (CN)

(72) Inventors: Yongtao Wang, Shandong (CN); Tingtiing Guan, Shandong (CN); Jian Li, Shandong (CN); Zhongni Wu, Shandong (CN); Baosheng Yan, Shandong (CN); Guangfen Jia, Shandong (CN)

(73) Assignee: QINGDAO HAIER AIR CONDITIONER GENERAL CORP., LTD., Qingdao, Shandong (CN)

( * ) Notice: Subject to any disclaimer, the term of this patent is extended or adjusted under 35 U.S.C. 154(b) by 398 days.

(21) Appl. No.: 15/109,501

(22) PCT Filed: Mar. 13, 2015

(86) PCT No.: PCT/CN2015/074186
§ 371 (c)(1),
(2) Date: Jul. 1, 2016

(87) PCT Pub. No.: WO2016/029676
PCT Pub. Date: Mar. 3, 2016

(65) Prior Publication Data

US 2017/0176025 A1 Jun. 22, 2017

(30) Foreign Application Priority Data

Aug. 29, 2014 (CN) ..... 2014 1 04343547

(51) Int. Cl.
*F24F 1/0011* (2019.01)
*F24F 1/00* (2019.01)
(Continued)

(52) U.S. Cl.
CPC ..... *F24F 1/0011* (2013.01); *F24F 1/00* (2013.01); *F24F 1/0025* (2013.01);
(Continued)

(58) Field of Classification Search
CPC ..... F24F 1/00; F24F 1/0003; F24F 1/0007; F24F 1/0011; F24F 1/0025;
(Continued)

(56) References Cited

U.S. PATENT DOCUMENTS 3,097,506 A * 7/1963 Blakesley, Sr. ..... F24F 1/02 454/284
3,394,755 A * 7/1968 Morrison ..... F24F 9/00 165/103

(Continued)

*Primary Examiner* — Len Tran
*Assistant Examiner* — Gustavo Hincapie Serna
(74) *Attorney, Agent, or Firm* — Tim Tingkang Xia, Esq.; Locke Lord LLP

(57) ABSTRACT

A wall-mounted air conditioner indoor unit includes a housing having a front housing and a rear housing, main air intake portions formed on the housing, a mixed air outlet formed on a lower portion of the front housing, a non-hot exchange air inlet formed on the rear housing, and an air delivery apparatus disposed inside the housing. The hot exchange air passage has an upper portion with a size greater than that of its lower portion. A volute and a centrifugal fan located inside the volute are disposed inside the housing and above the air delivery apparatus. An air output portion of the volute faces the hot exchange air passage, and includes a surrounding portion extending to the air delivery apparatus and surrounding the hot exchange air passages, and air mixed cavities are formed between the surrounding portion and the hot exchange air passages.

15 Claims, 4 Drawing Sheets

(51) Int. Cl.

| | |
|---|---|
| ***F24F 13/06*** | (2006.01) |
| ***F24F 1/01*** | (2011.01) |
| ***F24F 1/0025*** | (2019.01) |
| ***F24F 1/0059*** | (2019.01) |
| ***F24F 13/20*** | (2006.01) |

(52) U.S. Cl.
CPC ..... *F24F 1/0059* (2013.01); *F24F 1/01* (2013.01); *F24F 13/06* (2013.01); *F24F 13/20* (2013.01); *F24F 2001/0048* (2013.01); *F24F 2013/0612* (2013.01)

(58) Field of Classification Search
CPC ..... F24F 2001/0037; F24F 2001/0048; F24F 2001/0059; F24F 1/0074; F24F 1/0081; F24F 1/01; F24F 13/06; F24F 2013/0612; F24F 2013/0616; F24F 13/20; F24F 2013/2051; F04D 29/162
USPC ..... 165/53, 55, 56, 120, 125
See application file for complete search history.

(56) References Cited

U.S. PATENT DOCUMENTS 5,333,835 A * 8/1994 Smith ..... F24F 13/16 137/554
5,564,495 A * 10/1996 Yoshihashi ..... F24F 1/0007 165/122
6,382,305 B1 * 5/2002 Sano ..... B60H 3/0608 165/103
6,412,298 B2 * 7/2002 Kang ..... F24F 1/027 62/262
7,503,383 B2 * 3/2009 Yamaguchi ..... B60H 1/00021 165/122
7,603,873 B2 * 10/2009 Tonin ..... F24F 1/027 62/262
7,997,328 B2 * 8/2011 Kim ..... F24F 12/006 165/122
8,069,674 B2 * 12/2011 Bell ..... F24F 5/0042 62/3.3
8,640,466 B2 * 2/2014 Bell ..... F25B 21/02 62/3.7
8,910,492 B2 * 12/2014 Ikeda ..... F04D 17/04 62/263
9,206,815 B2 * 12/2015 Shiraichi ..... F04D 29/282
9,466,284 B2 * 10/2016 Takeda ..... F24F 1/0007
9,752,795 B2 * 9/2017 Park ..... F24F 1/0007
2004/0083740 A1 * 5/2004 Taban ..... B60H 1/00464 62/3.2
2010/0050682 A1 * 3/2010 Ariga ..... F24F 1/025 62/401
2014/0242901 A1 * 8/2014 Lee ..... F24F 13/06 454/339

* cited by examiner

WALL-MOUNTED AIR CONDITIONER INDOOR UNIT

CROSS-REFERENCE TO RELATED APPLICATIONS

This application is a U.S. national phase application of PCT Patent Application Serial No. PCT/CN2015/074186, filed Mar. 13, 2015, and claims priority to and benefit of Chinese Patent Application No. 201410434354.7, filed Aug. 29, 2014 in the State Intellectual Property Office of P.R. China, which are incorporated herein by reference in their entireties.

FIELD OF THE INVENTION

The present invention relates generally to the field of air conditioning, and specifically, to an air conditioner indoor unit, and more specifically, to a wall-mounted air conditioner indoor unit.

BACKGROUND OF THE INVENTION

All existing wall-mounted air conditioner indoor units are stripe-shaped. The indoor units are provided with stripe-shaped air outlets. Air from heat exchanging of a heat exchanger, driven by an interior cross-flow fan, is directly blown out of an air outlet. The blown air is completely hot exchange air. Generally, no air delivery apparatus is disposed between the heat exchanger and the air outlet. For such type of air conditioners, one disadvantage is that, since all output air is hot exchange air, an air volume of air flowing is relatively small, and a circulation speed of indoor air is slow. Another disadvantage is that output air is not gentle enough. Especially, in a refrigeration mode, cool air blown out is directly blown to a user, which may make the use feel uncomfortable.

Because the wall-mounted air conditioner is mounted at a relatively high position in a room in use, it is desired that an air output direction of the wall-mounted air conditioner is downward, so as to speed up flow and temperature adjustment of air in the room.

In view of this, an objective of the present invention is to provide a wall-mounted air conditioner indoor unit that can not only output mixed air, but also blow the mixed air downwards.

SUMMARY OF THE INVENTION

An objective of the present invention is to provide a wall-mounted air conditioner indoor unit. The indoor unit can not only output gentle mixed air having a large air volume and a suitable temperature, but also blow the mixed air out downwards, so as to improve flowability and temperature adjustability of space air when the wall-mounted air conditioner indoor unit is used.

To implement the foregoing objective of the present invention, the following technical solutions are used in the present invention for implementation:

A wall-mounted air conditioner indoor unit includes a front housing and a rear housing forming a housing of the indoor unit, the housing is provided with main air intake portions, and heat exchangers are disposed inside the housing, a lower portion of the front housing is provided with a mixed air outlet, a position that is on the rear housing and that is corresponding to the mixed air outlet is provided with a non-hot exchange air inlet, an air delivery apparatus is disposed inside the housing, the air delivery apparatus includes at least two air-duct bodies that are go-through in the middle and that have front and rear openings, the air-duct bodies are sequentially arranged next to one another, and a throughway air passage that is go-through from the front to the back is disposed in the middle, the throughway air passage connects the mixed air outlet and the non-hot exchange air inlet, a hot exchange air passage is formed between two adjacent air-duct bodies of the air-duct bodies, a size of an upper portion of the hot exchange air passage is greater than a size of a lower portion of the hot exchange air passage, thereby forming a passage structure that is wide at the upper portion and narrow at the lower portion, a volute and a centrifugal fan located inside the volute are disposed inside the housing and above the air delivery apparatus, an air output portion of the volute faces the hot exchange air passage, the air output portion of the volute is further provided with a surrounding portion that extends to the air delivery apparatus and that surrounds the hot exchange air passages, and an air mixed cavity is disposed between the surrounding portion and the hot exchange air passages.

According to the wall-mounted air conditioner indoor unit as described above, the air delivery apparatus includes at least three air-duct bodies, and the at least three air-duct bodies are sequentially arranged next to one another in a spacing-gradually-increased structure in a direction from the non-hot exchange air inlet to the mixed air outlet.

Preferably, the air delivery apparatus includes three air-duct bodies, the three air-duct bodies are formed into two hot exchange air passages, and a size of a rear hot exchange air passage close to the non-hot exchange air inlet is less than a size of a front hot exchange air passage proximate to the mixed air outlet.

According to the wall-mounted air conditioner indoor unit as described above, both a front opening of a front air-duct body, proximate to the mixed air outlet, of the air delivery apparatus and the mixed air outlet incline downwards in a direction in which an upper portion is forward and a lower portion is backward.

Preferably, the front opening of the front air-duct body and the mixed air outlet incline downwards in an angle of 4°-45°.

According to the wall-mounted air conditioner indoor unit as described above, a distance from the top of the air delivery apparatus to the air output portion of the volute is greater than a distance from the bottom of the air delivery apparatus to the bottom of the surrounding portion.

Preferably, the bottom of the air delivery apparatus is adjacent to or in contact with the bottom of the surrounding portion.

According to the wall-mounted air conditioner indoor unit as described above, the surrounding portion gradually expands downwards relative to the air delivery apparatus from a starting end connecting to the air output portion of the volute, so that air mixed cavities whose inner cavities gradually expand are formed on left and right sides of the air delivery apparatus.

According to the wall-mounted air conditioner indoor unit as described above, the air output portion of the volute faces the hot exchange air passages in an inclined direction in which an upper portion is backward and a lower portion is forward, and the surrounding portion surrounds the hot exchange air passages in an inclined direction in which an upper portion is backward and a lower portion is forward.

According to the wall-mounted air conditioner indoor unit as described above, the centrifugal fan is a double-suction-type centrifugal fan, an axis of the centrifugal fan is perpendicular to an axis of the air delivery apparatus, and the volute is provided with a first air intake portion and a second air intake portion that are bilaterally symmetrical.

According to the wall-mounted air conditioner indoor unit as described above, the main air inlets include the first main air inlet and the second main air inlet forming on left and right sides of the housing, the heat exchangers include the first heat exchanger located between the first main air inlet and the volute and the second heat exchanger located between the second main air inlet and the volute, the first air intake portion faces the first heat exchanger, and the second air intake portion faces the second heat exchanger.

Preferably, both the first heat exchanger and the second heat exchanger are two-folded and multi-layer heat exchangers and extend downwards from the volute to surround a part of the surrounding portion.

Preferably, a distance between an axle center of the centrifugal fan and the top of the housing is not less than ¼ of an overall length of the housing.

Preferably, the centrifugal fan is a double-suction-type centrifugal fan whose rotors are externally disposed.

According to the wall-mounted air conditioner indoor unit as described above, orthographic projections of the front housing and the rear housing are both circular or approximately circular.

Compared with the prior art, advantages and positive effects of the present invention are as follows:

According to the wall-mounted air conditioner indoor unit in the present invention, an air delivery apparatus is disposed on a lower portion of a housing, a centrifugal fan is disposed on the air delivery apparatus, an air output portion, which faces a hot exchange air passage, of the centrifugal fan is provided with a surrounding portion that surrounds the hot exchange air passage, hot exchange air in an inner passage of the indoor unit is carded and buffered by using air mixed cavities formed of the surrounding portions and then is uniformly emitted to the air delivery apparatus in a circumference direction of the air delivery apparatus, and a part of external non-hot exchange air on which heat exchange is not performed is guided to join final output of air of an air conditioner by using a pressure formed in a throughway air passage, which increases an entire air intake volume of an air conditioner, speeds up flow of inner air, and further improves entire uniformity of indoor air. Moreover, mixed air like this is relatively gentle, and when the mixed air is blown to a body of a user, the user feels more comfortable, which improves an experience effect of suitability of the user. Moreover, the air delivery apparatus is located at a lower portion of the housing, and mixed air that is blown out is in a downward direction. When a wall-mounted air conditioner indoor unit is installed at a relatively high position in a room, mixed air can directly enter space of the room without obstacles, thereby improving flowability and temperature adjustability of air.

After exemplary embodiments of the present invention are described with reference to the accompanying drawings, another feature and advantage of the present invention is clearer.

DETAILED DESCRIPTION OF THE INVENTION

To make the objectives, technical solutions, and advantages of the present invention clearer and more comprehensible, the following further describes the present invention in detail with reference to the accompanying drawings and embodiments.

A brief introduction is first made to technical terms involved in exemplary embodiments: "front", "rear", "left", and "right", which are referred to in the following, of each structure are defined relative to a position of a user in a state in which a structure member is normally used. Descriptions: "front", "rear", "left", and "right" on an arrangement position of multiple structure members are also defined relative to a position of a user in a state in which an apparatus formed of multiple structure members is normally used. Hot exchange air described below refers to air that is from an interior of an air conditioner and on which heat exchanging is performed by using a heat exchanger. Non-hot exchange air refers to air that is from environmental space in which an air conditioner is located and that is not directly from a heat exchanger relative to hot exchange air. Mixed air refers to air formed because of mixture of hot exchange air and non-hot exchange air.

Refer to an embodiment, which is shown in FIG. 1 to FIG. 6, of a wall-mounted air conditioner indoor unit according to the present invention.

Figure 1:
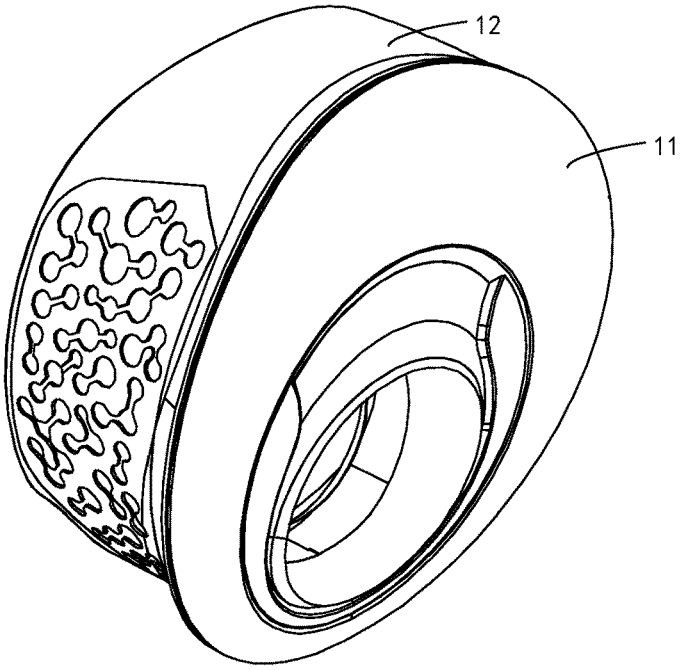
FIG. 1 is a perspective view of a wall-mounted air conditioner indoor unit according to one embodiment of the present invention.
Figure 2:
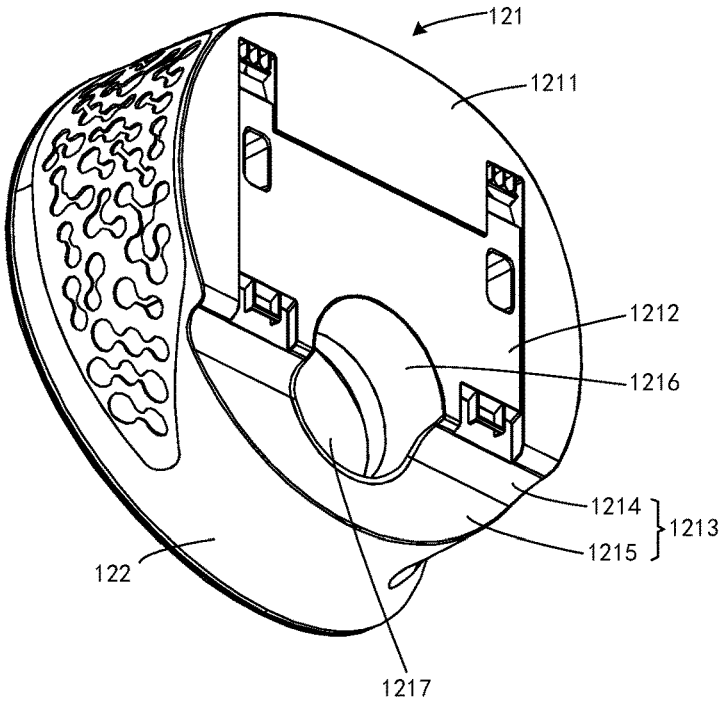
FIG. 2 is another perspective view of the wall-mounted air conditioner indoor unit according to the embodiment of the present invention.
Figure 3:
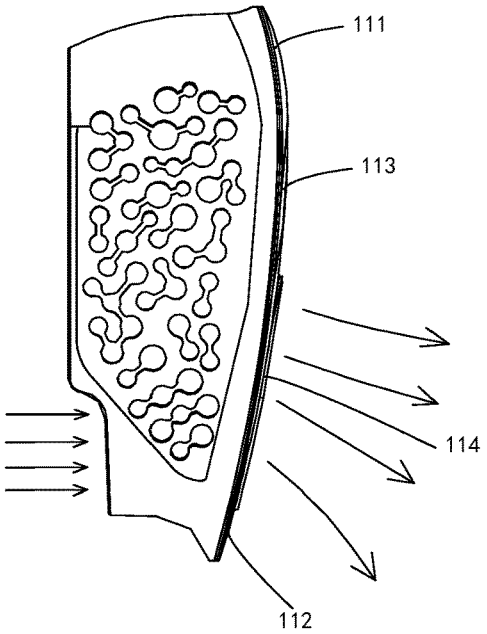
FIG. 3 is a side view of the wall-mounted air conditioner indoor unit according to the embodiment of the present invention.
Figure 4:
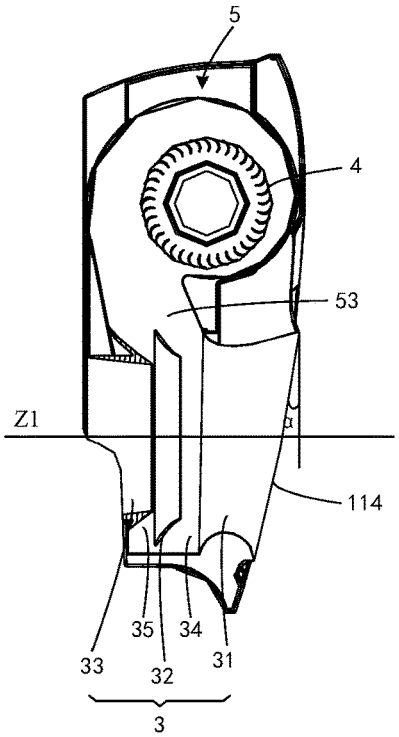
FIG. 4 is a sectional view of the wall-mounted air conditioner indoor unit along a direction parallel with an axis of an air delivery apparatus according to the embodiment of the present invention.
Figure 5:
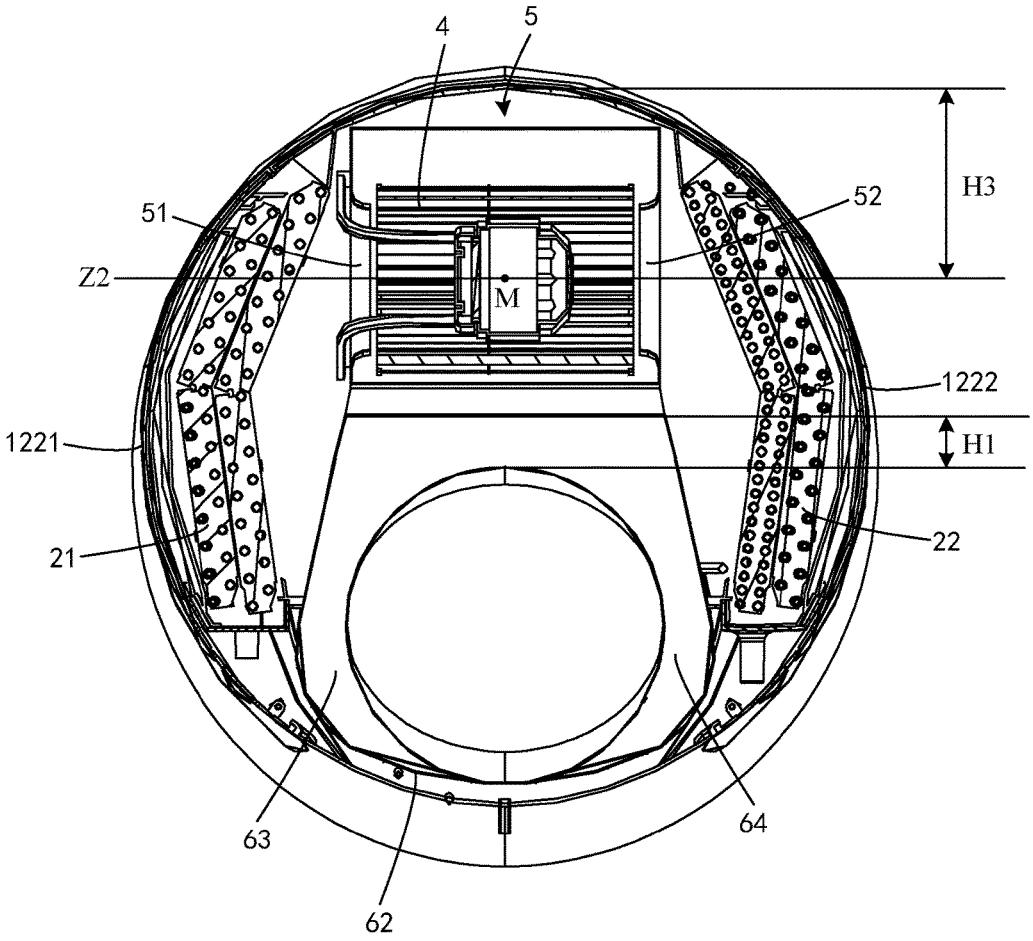
FIG. 5 is a sectional view of the wall-mounted air conditioner indoor unit along a direction perpendicular to an axis of an air delivery apparatus according to the embodiment of the present invention.
Figure 6:
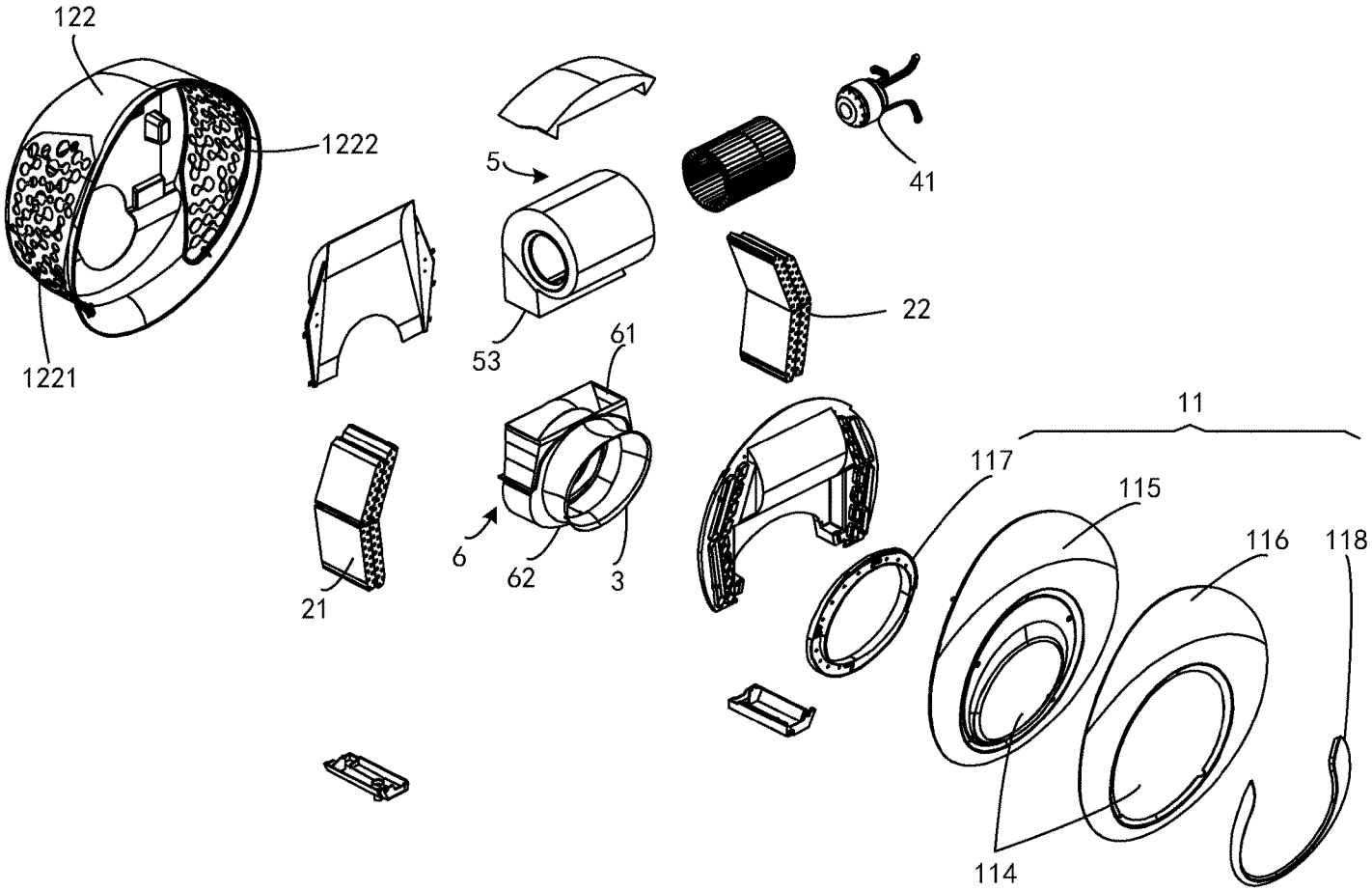
FIG. 6 is an exploded view of the wall-mounted air conditioner indoor unit according to the embodiment of the present invention.

FIG. 1 and FIG. 2 are two solid figures of the embodiment, FIG. 3 is a side view of the embodiment, FIG. 4 and FIG. 5 are separately sectional views, which are along a direction parallel with and perpendicular to an axis of an air delivery apparatus, of the embodiment, and FIG. 6 is an exploded structural diagram of the embodiment.

The wall-mounted air conditioner indoor unit in the embodiment includes a front housing 11 and a rear housing 12, and the two may be detachably connected, so as to form a housing of the indoor unit. Preferably, orthographic projections of the front housing 11 and the rear housing 12 are both circular or approximately circular, that is, a profile curve of the front housing and a profile curve of the rear housing (which are not shown in the figure) are both circular or approximately circular. Therefore, an orthographic projection of an entire indoor unit is also circular or approximately circular, so that an entire indoor unit has a unique and nice appearance, which is totally different from that of an existing stripe-shaped wall-mounted air conditioner indoor unit and meets a personalized aesthetic demand of a user.

Specifically, a structure of the front housing 11 is: for a surface of the front housing 11, both an upper portion 111 of the front housing and a lower portion 112 of the front housing contract backwards, and a middle portion 113 of the front housing protrudes forwards, so that the surface of the front housing 11 is an arc surface in which the upper portion and the lower portion contract inwards and the middle portion protrudes outwards. The rear housing 12 is located within a limiting area of the front housing 11. That is, an outer profile curve of the front housing 11 is located outside an outer profile curve of the rear housing 12. Therefore, an area presented by the wall-mounted air conditioner indoor unit is an area of the front housing 11, and because the upper portion and the lower portion of the front housing contract backwards, from the back of frontage, an outline size of the front housing 11 is small. In addition, the middle portion protrudes outwards, so that in a case in which the outline size is relatively small, a heat exchanger having a relatively large area and a centrifugal fan having a large air intake volume can be disposed inside the housing, to make the indoor unit meet an air volume requirement and a temperature adjustment requirement during air cooling and heating. The lower portion of the front housing 11, specifically, the lower portion 112 of the front housing, is provided with a mixed air outlet 114. The mixed air outlet 114 is disposed on the lower portion 112, whose surface contracts backwards, of the front housing, the mixed air outlet 114 is formed in an inclined direction in which the upper portion is forward, and the lower portion is backward, and an inclined angle of the mixed air outlet 114 is $\alpha$ meeting $4° \leq \alpha \leq 45°$. More preferably, the inclined angle is about 10°. The mixed air outlet 114 is set in this manner, in cooperation with structure design of a subsequent air delivery apparatus 3, so that air output from the mixed air outlet 114 can be blown forwards and backwards, which effectively avoids a problem that when the indoor unit is mounted at a relatively high position in a room and air output from an air outlet is blown up to a ceiling, an air volume and temperature adjustment of indoor flow air are affected.

Further, the front housing 11 includes a front panel 115, a decoration plate 116 and a decoration cover. The front panel 115 and the decoration plate 116 have a same outer profile and constitute a body of the front housing 11. The decoration plate 116 is located on a front surface of the front panel 115 and is connected to the front panel 115. For example, the decoration plate 116 is detachably connected to the front panel 115 by using a buckle and/or a screw; or is stuck to the front panel 115 by using glue. Same openings are formed on the front panel 115 and the decoration plate 116, and the two openings form the mixed air outlet 114. The decoration cover includes a detachably connected base 117 and a cover plate 118. The two components are buckledly mounted at an edge of the mixed air outlet 114 after being connected, thereby forming a decoration side of the mixed air outlet 114. Light in different colors may be set in the decoration cover to brighten the air outlet and give an instruction on output of air.

The rear housing 12, as a main part of the housing, has a thickness greater than a thickness of the front housing 11. Besides, a body of the rear housing 12 is of a cylinder-shaped structure and includes a rear plate 121 and a side wall 122. In the middle of the two parts, a relatively large accommodation space is formed by means of surrounding, so as to accommodate and place another component of the indoor unit, for example, the heat exchanger, a centrifugal fan, a water pan, and a volute. Left and right sides of the side wall 122 are symmetrically provided with a first main air intake portion 1221 and a second main air intake portion 1222. The two air intake portions preferably include multiple air inlets that are not connected to each other. Compared with an existing air intake grill, the air intake portion has a large air intake volume and easily clean dusts and sundries. When an integrity is formed, the front panel 115 in the front housing 11 is connected to the side wall 122. From the front of the indoor unit, both the first main air intake portion 1221 and the second main air intake portion 1222 are located within a limiting area of the front panel 115. Therefore, the mixed air outlet 114 disposed on the lower portion of the front housing 11 is relatively far away from the two main air intake portions, so that a problem that air of the air outlet and the air intake portion is mixed does not occur.

In addition, the rear plate 121 is provided with a mounting surface 1211, the mounting surface 1211 is provided with a wallboard 1212, and the indoor unit is fastened to and mounted on a wall by using the wallboard 1212. The rear plate 121 is further provided with a breach 1213, the breach 1213 includes a first surface 1214 perpendicular to and connected to the mounting surface 1211 and a second surface 1215 far away from the mounting surface 1211 and parallel with the mounting surface 1211, the second surface 1215 is provided with a non-hot exchange air inlet 1217, and a position of the non-hot exchange air inlet 1217 corresponds to that of the mixed air outlet 114 of the front housing 11. More preferably, the first surface 1214 is provided with an air intake cavity 1216, and the non-hot exchange air inlet 1217 is partially located in the air intake cavity 1216. The foregoing structure is used. After the indoor unit is mounted on the wall, an air intake empty cavity is preserved for the non-hot exchange air inlet 1217, thereby implementing unhindered air intake of the non-hot exchange air inlet 1217 and improving flow air performance of an air conditioner. In addition, an area of the mounting surface 1211 is not reduced and a mounting strength is not affected due to an excessively preserved empty cavity.

An interior of the housing formed of the front housing 11 and the rear housing 12 is provided with the heat exchanger, an air delivery apparatus 3, a centrifugal fan 4, a volute 5, and a surrounding portion 6.

Specifically, the air delivery apparatus 3 is disposed below and includes three air-duct bodies that are sequentially arranged from the front to the back, that is, in a direction from the front housing 11 to the rear housing 12, which are separately a front air-duct body 31, a middle air-duct body 32, and a rear air-duct body 33. All of the three air-duct bodies that are sequentially arranged from the front to the back are ring-shaped. The front air-duct body 31 is go-through in the middle and has front and rear openings, which are separately a mixed air outlet and an air inlet (which are not shown in the figure). The middle air-duct body 32 is go-through in the middle and has front and rear openings, which are separately an air outlet and an air inlet (which are not shown in the figure). The rear air-duct body 33 is go-through in the middle and has front and rear openings, which are separately an air outlet and a non-hot exchange air inlet (which are not shown in the figure). After the front air-duct body 31, the middle air-duct body 32, and the rear air-duct body 33 are sequentially arranged from the front to the back, a throughway air passage (which is not shown in the figure) that goes through all of three air-duct bodies from the front to the back is disposed in the middle. In addition, the mixed air outlet 114 and the non-hot exchange air inlet 1217 are connected by means of the throughway air passage. A mixed air outlet of the front air-duct body 31 and the mixed air outlet 114 are interconnected, and a non-hot exchange air inlet of the rear air-duct body 33 and the non-hot exchange air inlet 1217 are interconnected. A first hot exchange air passage 34 is disposed between the front air-duct body 31 and the middle air-duct body 32, and a second ring-shaped hot exchange air passage 35 is disposed between the middle air-duct body 32 and the rear air-duct body 33. Moreover, both of the two hot exchange air passages are ring-shaped.

The centrifugal fan 4 is disposed above the air delivery apparatus 3 and is located inside the volute 5. The centrifugal fan 4 is preferably a double-suction-type centrifugal fan in which rotors of a motor 41 are externally disposed, and an axis z2 of the centrifugal fan 4 is perpendicular to an axis z1 of the air delivery apparatus 3. Further, internal space of the housing can be effectively used, and a fan length of the centrifugal fan 4 is increased to improve an air volume of the indoor unit and the heat exchange efficiency and reduce power consumption. Correspondingly, the volute 5 has the first air intake portion 51 and the second air intake portion 52 that are bilaterally symmetrical. Openings of the two air intake portions face outwards and can take in air from left and right sides under the function of the centrifugal fan 4. An air output portion 53 of the volute 5 faces the air delivery apparatus 3, and specifically, faces the two hot exchange air passages of the air delivery apparatus 3. The air output portion 53 of the volute 5 is provided with a surrounding portion 6 that extends to the air delivery apparatus 3 and that surrounds two hot exchange air passages. An air mixed cavity is disposed between the surrounding portion 6 and the two hot exchange air passages. Specifically, the air output portion 53 of the volute 5 faces the hot exchange air passages in an inclined direction in which an upper portion is backward and a lower portion is forward, and the surrounding portion 6 surrounds the hot exchange air passages in an inclined direction in which an upper portion is backward and a lower portion is forward. Therefore, air blown out of the volute 5 enters the air mixed cavity and the hot exchange air passage at convenience in an inclined and downward direction and is output by means of the air delivery apparatus 3 in an inclined and downward inertial direction. Moreover, the surrounding portion 6 gradually expands downwards relative to the air delivery apparatus 3 from a starting end 61 of the surrounding portion 6 connecting to the air output portion 53 of the volute 5, so that an air mixed cavity 63 and a second mixed cavity 64 whose inner cavities gradually expand are formed on left and right sides of the air delivery apparatus 3. Moreover, the first air mixed cavity 63 and the second air mixed cavity 64 are bilaterally symmetrical by using a straight line perpendicular to the axis of the air delivery apparatus 3 as a symmetry axis. Therefore, hot exchange air blown out of the air output portion 53 of the volute 5 enters the first air mixed cavity 63 and the second air mixed cavity 64 under limiting and guiding of the surrounding portion 6. Carding and filling is performed on air currents in the two symmetrical air mixed cavities, and until the air mixed cavities are full, air on the left and right sides has an equal air volume and an equal air speed. Then, the air uniformly enters two ring-shaped hot exchange air passages in left and right and upward directions of the air delivery apparatus 3.

Moreover, in this embodiment, a distance between the top of the air delivery apparatus 3 and the air output portion 53 of the volute 5 is H1, and a distance between the bottom of the air delivery apparatus 3 and the bottom 62 of the surrounding portion is H2 (which is not shown in the figure), where H1 is greater than H2, and the air delivery apparatus 3 and the bottom 62 of the surrounding portion are close to a lower end of the housing as much as possible, so that a length of the surrounding portion 6 can be stretched, which provides an air mixed cavity that has an enough length to fully mix air together. Moreover, a delivery area that has an enough length can be disposed between the surrounding portion 6 and the air output portion 53 of the volute 5, to implement static pressure recovery. In addition, to enable air that is blown out of the mixed air outlet 114 to move in an inclined and downward direction, besides that the mixed air outlet 114 and the mixed air outlet of the front air-duct body 31 interconnected with the mixed air outlet 114 are set to incline downwards in a direction in which an upper portion is forward and a lower portion is backward, the bottom of the air delivery apparatus 3 is close to or in contact with the bottom 62 of the surrounding portion as much as possible, so that only little air is blown out of bottoms of hot exchange air passages of the air delivery apparatus 3. After being blown out of upper and middle portions of the hot exchange air passages, most air is output along a throughway air passage and the mixed air outlet 114 in an inclined and downward direction.

More preferably, the first hot exchange air passage 34 and the second hot exchange air passage 35 are set in such a manner: For each hot exchange air passage, a size of an upper portion is greater than a size of a lower portion. For example, a width of the hot exchange air passage is gradually reduced from up to down, thereby forming a passage structure that is wider at the upper portion and narrower at the lower portion. Because the hot exchange air passage is wider in the upper portion and narrower in the lower portion, air blown out of the air output portion 53 of the volute 5 is mostly blown out via a wider position of the hot exchange air passage, that is, the middle and upper portions, and further, can further enable the air output from the mixed air outlet 114 to move in an inclined and downward direction.

Further, the three air-duct bodies are set in such a manner: The three air-duct bodies are sequentially arranged next to one another in a spacing-gradually-increased structure in a direction from the non-hot exchange air inlet 1217 to the mixed air outlet 114, so that sizes of the hot exchange air passages sequentially become large from the back to the front. That is, a size of the first hot exchange air passage 34 is greater than a size of the second hot exchange air passage 35. For example, a width of the first hot exchange air passage 34 is greater than a size of a corresponding position of a second hot exchange air passage 35. Setting like this can ensure that air that is output from a rear end of the air output portion 53 of the volute 5 and that has a relatively large air speed is fully guided to the throughway air passage, increase an air speed in the throughway air passage, and further increase an air volume of lured air from the non-hot exchange air 1217.

For the centrifugal fan 4, to ensure that efficiency of air intake from left and right sides and exchanging heat by means of an evaporimeter and whole machine vibration reach the standard, a distance H3 between an axle center M of the centrifugal fan 4 and the top of the housing ought to be not less than ¼ of an overall height of the housing.

In this embodiment, corresponding to the first main air intake portion 1221, the second main air intake portion 1222, and the centrifugal fan 4, the heat exchangers include a first heat exchanger 21 located between the first main air intake portion 1221 and the volute 5 and a second heat exchanger 22 located between the second main air intake portion 1222 and the volute 5. The first main air intake portion 1221 faces the first heat exchanger 21, and the second main air intake portion 1222 faces the second heat exchanger 22. Moreover, both the first heat exchanger 21 and the second heat exchanger 22 are two-folded and multi-layer heat exchangers, for example, two-folded and four-layer heat exchangers, and extend downwards from the volute 5 to surround a part of the surrounding portion 6. By means of design of this structure, it may be ensured that air of the external is taken into to a low-voltage region of a middle portion of the centrifugal fan 4 by using the main air intake portions and heat exchangers on two sides in a least-changed angle and shortest distance, thereby reducing a flow channel pressure loss, improving an indoor circulation air volume, and reducing noises of a whole machine. Moreover, air on which flow adjustment and static pressure recovery are performed by the centrifugal fan 4 is collected in the air mixed cavity and is blown out by the air delivery apparatus 3 out of the mixed air outlet 114. When the air is blown out, by using a pressure in the throughway air passage in the air delivery apparatus 3, non-hot exchange air is guided from the non-hot exchange air inlet 1217 to join final output of air, which increases an entire air intake volume of an air conditioner, speeds up flow of inner air, and further improves entire uniformity of indoor air. Moreover, mixed air like this is relatively gentle, and when the mixed air is blown to a body of a user, the user feels more comfortable, which improves an experience effect of suitability of the user.

The foregoing embodiments are merely intended for describing the technical solutions of the present invention but not for limiting the present invention. Although the present invention is described in detail with reference to the foregoing embodiments, persons of ordinary skill in the art may still make modifications to the technical solutions recorded in the foregoing embodiments or make equivalent replacements to some technical features thereof. These modifications or replacements do not make the essence of the corresponding technical solutions depart from the spirit and scope of the technical solutions of the present invention.

What is claimed is:

1. A wall-mounted air conditioner indoor unit, comprising a front housing and a rear housing forming a housing of the indoor unit, the housing being provided with main air intake portions, and heat exchangers being disposed inside the housing, wherein a mixed air outlet is formed in a lower portion of the front housing, a non-hot exchange air inlet is formed on the rear housing at a position corresponding to the mixed air outlet, an air delivery apparatus is disposed inside the housing, the air delivery apparatus comprises at least two air-duct bodies each having front and rear openings, the air-duct bodies are sequentially arranged next to one another to form a throughway air passage therebetween, the throughway air passage connects the mixed air outlet and the non-hot exchange air inlet, a hot exchange air passage is formed between two adjacent air-duct bodies of the air-duct bodies, a size of an upper portion of the hot exchange air passage is greater than that of a lower portion of the hot exchange air passage, thereby forming a passage structure that is wide at the upper portion and narrow at the lower portion, a volute and a centrifugal fan located inside the volute are disposed inside the housing and above the air delivery apparatus, an air output portion of the volute faces the hot exchange air passage, the air output portion of the volute includes a surrounding portion that extends to the air delivery apparatus and surrounds the hot exchange air passage, and air mixed cavities are formed between the surrounding portion and the hot exchange air passage.

2. The wall-mounted air conditioner indoor unit according to claim 1, wherein the air delivery apparatus comprises at least three air-duct bodies, and the at least three air-duct bodies are sequentially arranged next to one another in a spacing-gradually-increased structure in a direction from the non-hot exchange air inlet to the mixed air outlet.

3. The wall-mounted air conditioner indoor unit according to claim 2, wherein the air delivery apparatus comprises three air-duct bodies, the three air-duct bodies are formed into two hot exchange air passages, wherein the two hot exchange air passages are a rear hot exchange air passage and a front hot exchange air passage, and wherein a size of the rear hot exchange air passage close to the non-hot exchange air inlet is less than a size of the front hot exchange air passage proximate to the mixed air outlet.

4. The wall-mounted air conditioner indoor unit according to claim 1, wherein both a front opening of a front air-duct body, proximate to the mixed air outlet, of the air delivery apparatus and the mixed air outlet incline downwards in a direction in which an upper portion of the mixed air outlet is forward and a lower portion of the mixed air outlet is backward with respect to an intersection point of the mixed air outlet with an axis Z1 of the air delivery apparatus.

5. The wall-mounted air conditioner indoor unit according to claim 4, wherein the front opening of the front air-duct body and the mixed air outlet incline downwards in an angle of 4°-45°.

6. The wall-mounted air conditioner indoor unit according to claim 1, wherein a distance from the top of the air delivery apparatus to the air output portion of the volute is greater than a distance from the bottom of the air delivery apparatus to the bottom of the surrounding portion.

7. The wall-mounted air conditioner indoor unit according to claim 6, wherein the bottom of the air delivery apparatus is adjacent to or in contact with the bottom of the surrounding portion.

8. The wall-mounted air conditioner indoor unit according to claim 1, wherein the surrounding portion gradually expands downwards relative to the air delivery apparatus from a starting end connecting to the air output portion of the volute, so that air mixed cavities whose inner cavities gradually expand are formed on left and right sides of the air delivery apparatus.

9. The wall-mounted air conditioner indoor unit according to claim 1, wherein the air output portion of the volute faces the hot exchange air passage in an inclined direction with respect to an axis Z1 of the air delivery apparatus, and the surrounding portion surrounds the hot exchange air passage in an inclined direction with respect to a line perpendicular to the Z1 axis of the air delivery apparatus.

10. The wall-mounted air conditioner indoor unit according to claim 1, wherein the centrifugal fan is a double-suction-type centrifugal fan, an axis of the centrifugal fan is perpendicular to an axis of the air delivery apparatus, and the volute is provided with a first air intake portion and a second air intake portion that are bilaterally symmetrical.

11. The wall-mounted air conditioner indoor unit according to claim 10, wherein the main air portions comprise a first main air portion and a second main air portion forming on left and right sides of the housing, the heat exchangers comprise a first heat exchanger located between the first main air portion and the volute and a second heat exchanger located between the second main air portion and the volute, the first air intake portion faces the first heat exchanger, and the second air intake portion faces the second heat exchanger.

12. The wall-mounted air conditioner indoor unit according to claim 11, wherein both the first heat exchanger and the second heat exchanger are two-folded and multi-layer heat exchangers and extend downwards from the volute to surround a part of the surrounding portion.

13. The wall-mounted air conditioner indoor unit according to claim 10, wherein a distance between an axle center of the centrifugal fan and the top of the housing is not less than ¼ of an overall length of the housing.

14. The wall-mounted air conditioner indoor unit according to claim 10, wherein the centrifugal fan is a double-suction-type centrifugal fan whose rotors are externally disposed.

15. The wall-mounted air conditioner indoor unit according to claim 1, wherein orthographic projections of the front housing and the rear housing are both circular.

* * * * *